US006915635B2

(12) United States Patent
Wolf

(10) Patent No.: US 6,915,635 B2
(45) Date of Patent: Jul. 12, 2005

(54) METHOD AND DEVICE FOR OPERATING A STEAM POWER PLANT, IN PARTICULAR IN THE PART-LOAD RANGE

(75) Inventor: Thorsten Wolf, Nümberg (DE)

(73) Assignee: Siemens Aktiengesellschaft, Munich (DE)

( * ) Notice: Subject to any disclaimer, the term of this patent is extended or adjusted under 35 U.S.C. 154(b) by 169 days.

(21) Appl. No.: 10/440,410

(22) Filed: May 19, 2003

(65) Prior Publication Data

US 2003/0230088 A1 Dec. 18, 2003

(51) Int. Cl.[7] ..... F01K 13/02

(52) U.S. Cl. ..... 60/646; 60/657

(58) Field of Search ..... 60/646, 657

(56) References Cited

U.S. PATENT DOCUMENTS

| | | | | |
|---|---|---|---|---|
| 3,928,972 A | * | 12/1975 | Osborne | 60/646 |
| 4,215,552 A | | 8/1980 | Rlollet et al. | |
| 4,320,625 A | | 3/1982 | Westphal et al. | |
| 5,018,356 A | * | 5/1991 | Silvestri et al. | 60/646 |
| 5,136,848 A | * | 8/1992 | Silvestri, Jr. | 60/646 |
| 5,191,764 A | * | 3/1993 | Silvestri, Jr. | 60/660 |
| 5,333,457 A | * | 8/1994 | Silvestri, Jr. | 60/646 |
| 5,621,654 A | * | 4/1997 | Cohen et al. | 700/287 |
| 6,239,504 B1 | * | 5/2001 | Gobrecht et al. | 290/52 |

OTHER PUBLICATIONS

Patent Abstract of Japan, Publication No. 59226211, Publication Date: Dec. 19, 1984.

Patent Abstract of Japan, Publication No. 09317404, Publication Date: Dec. 9, 1997.

* cited by examiner

*Primary Examiner*—Hoang Nguyen
(74) *Attorney, Agent, or Firm*—Staas & Halsey LLP

(57) ABSTRACT

It is proposed that, during the operation of a steam turbine of a steam power plant, the internal pressure and also the internal temperature and, in the region outside it, the external temperature be determined in at least one steam-carrying component. As a result of a change in the operating state, in particular in the event of a load change, then, the abovementioned values vary, so that, under some circumstances, the mechanical stresses which in this case act on the steam-carrying component become unacceptably high. Consequently, a spatial temperature distribution and a reference stress of the steam-carrying component are determined from the abovementioned values and compared with a material limit stress. If the reference stress is greater than the material limit stress, a limit steam pressure desired value is determined, and at least one steam valve is set in such a way that the steam pressure on the steam-carrying component corresponds approximately to this limit steam pressure desired value. By the method according to the invention, an automatic reduction in the throttling is obtained, so that the efficiency of the steam power plant, in particular in the part-load range, is increased. A device according to the invention serves for carrying out the method according to the invention.

20 Claims, 1 Drawing Sheet

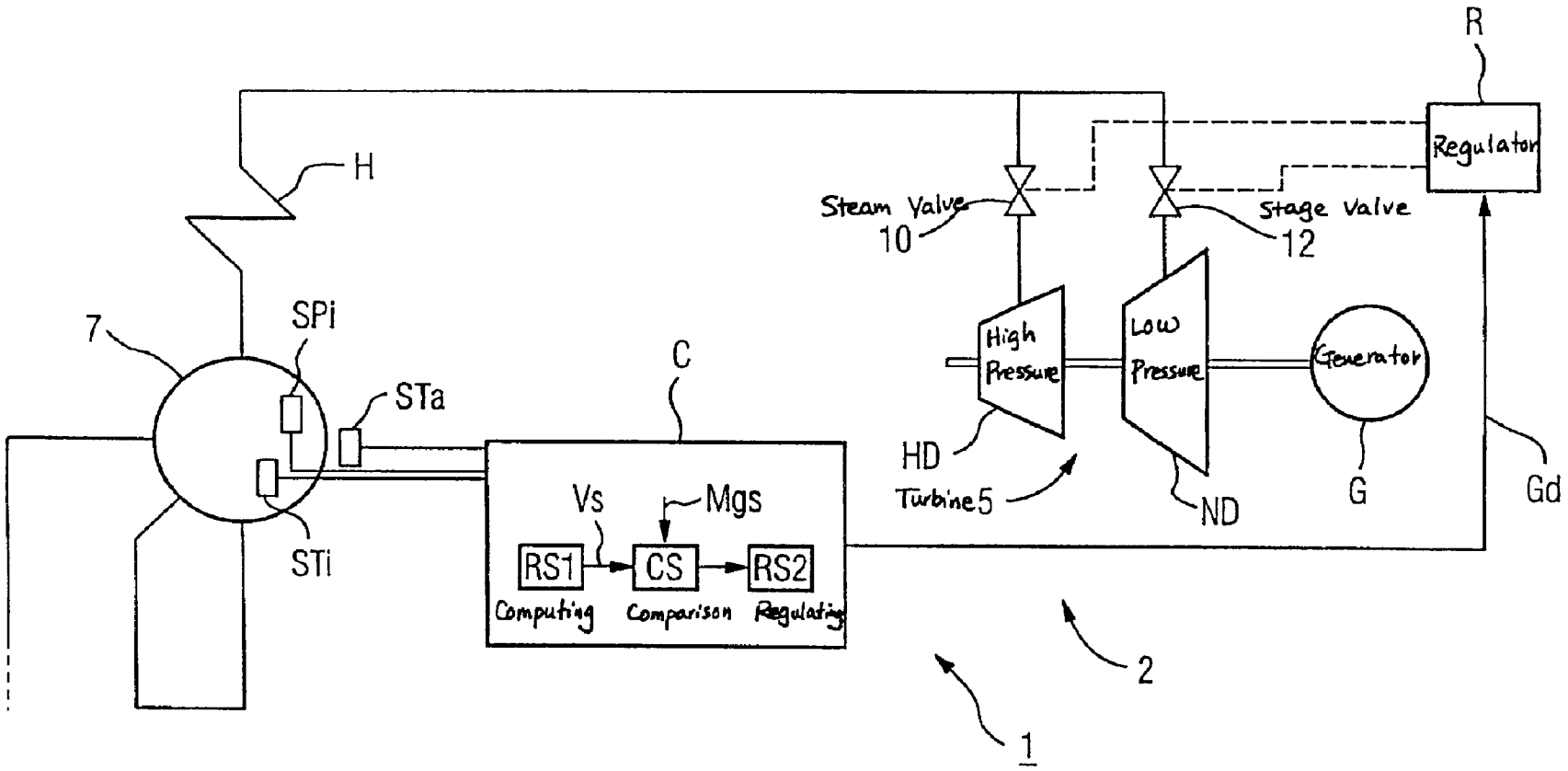
R
Regulator
Gd
Generator
G
Stage Valve
12
Low Pressure
ND
2
High Pressure
HD
Turbine 5
1
Steam Valve
10
C
Mgs
RS2
Regulating
CS
Comparison
Vs
RS1
Computing
STa
H
SPi
STi
7

METHOD AND DEVICE FOR OPERATING A STEAM POWER PLANT, IN PARTICULAR IN THE PART-LOAD RANGE

CROSS REFERENCE TO RELATED APPLICATIONS

This application is based on and hereby claims priority to European Application No. 02011279.3 filed on May 22, 2002, the contents of which are hereby incorporated by reference.

BACKGROUND OF THE INVENTION

Plants for the generation of electrical energy, in particular steam power stations, are conventionally designed for operating with a specific power output, the nominal power output, so that, when the plant is operating with this power output, optimum operating conditions of the numerous plant components are obtained, for example in terms of wear, frictional forces and frictional losses which occur, the generation of noise, exhaust gas behavior and efficiency.

In known power plants, there is often the problem that demand-related load changes cannot be carried out as quickly as desired while the power plant is in operation. For example, the speed of load change of steam power stations is restricted by the temperature variations occurring in one or more power station components as a result of a load change, in particular by the temperature variations in thick-walled plant components in which the temperature effects mentioned are particularly pronounced. Temperature variations of this kind have, inter alia, an adverse effect on a desired speed of load change which is as high as possible, since the temperature gradients which arise generate, in addition to the mechanical stresses prevailing in the affected plant component or plant components and caused, for example, during operation, further mechanical stresses in the material from which the plant component is manufactured. These additional stresses, caused by the temperature gradients mentioned, contribute to the fatigue of the material, so that the strength of the latter may decrease or else damage to the plant component is to be feared.

The problem mentioned arises particularly in the case of power plants with a high power output, which are designed as steam power stations and are equipped with a steam boiler which is operated by natural or forced circulation. The power plants mentioned comprise, as a rule, thick-walled drums for steam separation. In this case, in particular, the material of the steam separation drum is put at risk in the event of too rapid a load change as a result of the temperature gradients occurring under these circumstances, so that power plants of this type have hitherto been designed for operating in a constant-pressure regime, in order to avoid pressure and/or temperature fluctuations to which the steam separation drum is exposed. Such power plants known from the related art are therefore operated in the part-load range by a throttling of the turbine valves and/or by only partial action of operating steam on a first turbine stage, so that the pressure conditions in the part-load range are consequently comparable to the pressure conditions in the nominal-load range and the desired constant-pressure regime is thus obtained.

Such a throttling of the turbine valves, which is necessary during the entire operating time in the part-load range, brings about an appreciable loss of efficiency of the power plant, as compared with the efficiency of this plant which is achievable in the nominal-load range.

When the first turbine stage is acted upon only by part of the operating steam (partial action) in order to operate the power plant in the part-load range, this requires a special and complicated form of construction of the turbine, in which a regulating device, for example a regulating wheel, then has to be present in order to implement the possibility of partial action. Such a form of construction of the turbine is highly complicated in structural terms and is often susceptible to faults in operational terms.

SUMMARY OF THE INVENTION

One possible object on which the invention is based is, therefore, to specify an improved method and a device for operating a steam power plant, in particular in the part-load range.

At the same time, in particular, the disadvantages from the related art, such as for example, the considerable efficiency loss occurring in this case, are to be overcome.

With regard to the method, the object may be achieved by a method for operating a steam power plant with at least one steam turbine, the steam power plant having at least one steam-carrying component, and the steam turbine being acted upon by steam, in particular by fresh steam, by at least one steam valve, having the following steps:

1. During the operation of the steam power plant, at least one internal pressure and also at least one internal temperature and at least one external temperature of the steam-carrying component are determined.

2. A spatial distribution of the temperature of the steam-carrying component is determined from the at least one internal temperature and the at least one external temperature.

3. From the internal pressure and the spatial distribution of the temperature, a reference stress is determined, which describes the mechanical stress which the steam-carrying component undergoes in the current operating state.

4. The reference stress is compared with a material limit stress which describes an upper limit for the mechanical load-bearing capacity of the steam-carrying component, and 5. If the reference stress is greater than the material limit stress, a limit steam pressure desired value is determined, which describes a maximum permissible steam pressure, by which the steam-carrying component can be acted upon without the risk of damage in the current operating state, and the at least one steam valve is set in such a way that the steam delivered to the steam-carrying component by the steam turbine acts on the steam-carrying component with a pressure which corresponds approximately to the limit steam pressure desired value.

Particularly in the part-load range, continuous throttling of the turbine valves and the efficiency loss associated with this can be avoided when care is taken to ensure that, in particular, the stresses which occur in the material of the steam-carrying component do not become too great, but at the same time the upper mechanical load limit of the material of the steam-carrying component is utilized. The method therefore dispenses, inter alia, with too great a safety margin of the mechanical stresses actually prevailing in the material of the steam-carrying component from the maximum permissible mechanical stresses, in order thereby, in particular, to avoid too great an efficiency loss.

In order to achieve the outcome, from the measurements of the internal pressure and of the internal and the external temperature of the steam-carrying component, the spatial temperature distribution of the steam-carrying component and, subsequently, the reference stress can be determined, the reference stress being a variable for the mechanical stresses currently prevailing in the material of the steam-carrying component.

On the basis of the material from which the steam-carrying component is produced and of the geometry of the steam-carrying component, the material limit stress which describes an upper mechanical load limit of the steam-carrying component can be determined. In the relevant specialized literature on mechanical engineering and/or materials science is found a series of methods for determining such a material limit stress, the material used and the spatial configuration of the component considered, which is under mechanical stresses, usually playing a part.

If, then, in the method, it is established that the upper mechanical load limit of the steam-carrying component is exceeded, the maximum permissible steam pressure is determined which, in the current operating state, is to prevail at a maximum in the steam-carrying component, without excessive stress and/or damage having to be feared. On the basis of the upper load limit (material limit stress), therefore, a maximum steam pressure corresponding to this is determined, so that, when the steam-carrying component is acted upon by this maximum steam pressure, there is no risk of damage to the steam-carrying component. This maximum permissible steam pressure is then set, for example, by a regulating device, for example by a turbine controller, at least the steam valve being actuated correspondingly.

Since, in the method, the internal pressure and the temperatures of the steam-carrying component are measured continuously, for example cyclically, preferably during the entire operation of the steam power plant, the throttling, described in step 4 of the method, of the at least one steam valve is temporary, as compared with the related art where throttling is provided during the entire operating time of the power plant in the part-load range. This is possible particularly because, on account of the continuous measurements mentioned, the stress conditions of the steam-carrying component are known in every current operating state, so that, when the difference between the material limit stress and the reference stress decreases during operation, throttling can be cut back, since the limit steam pressure desired value occurring in the event of a decrease in the difference rises, thus allowing the cutback of the throttling of the at least one steam valve.

It can be the, in summary, that, in the method, the throttling of the turbine valves is temporary and is cut back according to the mutually balancing temperatures which are detected by the measurements in step 1.

By the method, for example, a steam power plant which comprises a thick-walled boiler can be operated in the sliding-pressure operating mode with fully open turbine valves and/or with full action upon the steam turbine; in comparison with known methods from the related art, in this case, in particular, permanent efficiency losses during part-load operation and a special and complicated configuration of the turbine with a regulating device for partial action are avoided.

The method is also to embrace those methods in which the variables determined in steps 2 to 5 are not determined on the basis of the respective geometry of the steam-carrying component "online" during the operation of the steam power plant, but, for example, are even stored beforehand in the form of parameterized curve groups (at least the internal pressure and the internal and external temperatures being used as parameters), and then, during operation, on the basis of the current parameter values at least for the internal pressure and the internal and the external temperature, the actuating action on the steam valve is derived from the abovementioned curve groups.

Advantageously, the steam-carrying component is a steam separation drum.

In this embodiment, the advantages of the method can be utilized particularly effectively, since steam separation drums, in particular of power plants with a high power output, have a thick-walled design, which, in the event of a load change, lead to particularly high mechanical stresses as a result of the temperature differences which occur in the thick walls of the steam separation drum. These stresses are avoided by the method, particularly at the commencement of a load change operation, in that high throttling of the at least one steam valve is set, which, however, is thereafter cut back automatically with the decreasing stresses as a result of the mutually balancing temperatures.

In a further embodiment, the steam turbine has at least two turbine stages, in particular a high-pressure and a low-pressure stage.

Steam turbines of this type are used, in particular, in power plants of relatively high power output, in order to utilize as effectively as possible the energy contained in the operating steam of the steam turbine.

Where a steam turbine of this type is used, it advantageously continues to be acted upon by steam by at least one stage valve, steam being capable of being delivered by the stage valve to at least one turbine stage, in particular the low-pressure stage. This stage valve is then set, in conjunction with the steam valve, in step 4 of the method. In this embodiment, the steam turbine of the steam power plant comprises at least two actuating members for the delivery of steam to the turbine. In step 4 of the method, then, the limit steam pressure desired value is implemented by the setting of the two valves, so that a better regulating behavior of the steam turbine in terms of the limit steam pressure desired value to be set is achieved, as compared with the setting of only one valve.

In a particularly preferred embodiment, the limit steam pressure desired value is determined by a simulation calculation.

In this case, a mathematical model of at least the steam-carrying component can be stored, for example, in a computer, by which model the reference stress in the material of the steam-carrying component and its time profile are calculated from the variables, measured in step 1, of the internal pressure and of the internal and the external temperature, the time profile being obtained from the pressure load, the temperature difference and, if appropriate, the actual spatial distribution of the mechanical stress in the material of the steam-carrying component. Such a simulation may be carried out, for example, by a digital method, the variables being read in and processed in a time-step method. Furthermore, in the simulation, it is possible, for example by the mathematical model of the steam-carrying component, to determine the limit steam pressure desired value which is normally supplied to a turbine controller which sets the turbine valve or turbine valves according to a control algorithm.

In this case, for example, the required limit steam pressure desired value and its time profile can be determined arithmetically by the mathematical model of the steam-carrying component, in that, for example, in the simulation calculation, starting from the measured internal pressure of the steam-carrying component, this current value of the internal pressure is increased in steps purely arithmetically, until the (initially theoretical) reference stress occurring in this case reaches or at least approaches the value of the material limit stress. The limit steam pressure desired value determined in this way can then be set so that no damage to the steam-carrying component need be feared.

With regard to the device, the object may be achieved by a device for operating a steam power plant with at least one steam turbine, the steam power plant having at least one steam-carrying component, and the steam turbine being capable of being acted upon by steam, in particular by fresh steam, by at least one steam valve, comprising the following components:

- an internal-pressure sensor, by which the pressure within the steam-carrying component can be determined,
- a unit to determine the temperature within the steam-carrying component,
- an external-temperature sensor, by which the temperature in the region outside the steam-carrying component can be determined,
- a computing stage, to which the determined values of the internal pressure and of the internal and external temperature are supplied and by which a spatial distribution of the temperature of the steam-carrying component and a reference stress can be determined, the reference stress describing the mechanical stress which the steam-carrying component undergoes in the current operating state,
- a comparison stage, by which the reference stress can be compared with a material limit stress which describes an upper limit for the mechanical load-bearing capacity of the steam-carrying component, and
- a regulating stage, by which, if the reference stress is greater than the material limit stress, a limit steam pressure desired value can be determined, which describes a maximum permissible steam pressure by which the steam-carrying component can be acted upon without the risk of damage in the current operating state, and by which regulating stage the at least one steam valve can be set in such a way that the steam delivered to the steam-carrying component by the steam turbine acts on the steam-carrying component with a pressure which corresponds approximately to the limit steam pressure desired value.

The internal temperature may be obtained, for example, by direct measurement by a sensor or indirectly by derivation from other physical variables (for example, boiling state and pressure of the filling medium of the steam-carrying component).

Advantageously, the steam-carrying component is a steam separation drum.

In a further advantageous embodiment, the steam turbine has at least two turbine stages, in particular a high-pressure and a low-pressure stage.

In this case, the steam turbine can advantageously continue to be acted upon by steam by at least one stage valve, steam being capable of being delivered to at least one turbine stage, in particular the low-pressure stage by the stage valve, and the at least one stage valve being capable of being set, in conjunction with the steam valve, by the regulating stage.

Particularly advantageously, the limit steam pressure desired value is determined by a simulation calculation.

The device according and its preferred embodiments serve particularly for implementing the above-described method and all its embodiments.

All the statements and explanations presented in connection with the method can readily be transferred in a similar way to the device and are not repeated here.

BRIEF DESCRIPTION OF THE DRAWINGS

These and other objects and advantages of the present invention will become more apparent and more readily appreciated from the following description of the preferred embodiments, taken in conjunction with the accompanying drawing which is a schematic diagram of a steam power plant.

DETAILED DESCRIPTION OF THE PREFERRED EMBODIMENT

Reference will now be made in detail to the preferred embodiments of the present invention, examples of which are illustrated in the accompanying drawings, wherein like reference numerals refer to like elements throughout.

The figure shows a steam power plant 1 which comprises a steam turbine 5 and at least one steam-carrying component 7. The latter is designed, in the present exemplary embodiment, as a steam separation drum.

No details of steam generation are depicted in the diagrammatic illustration of the figure, and, in particular, a detailed illustration of steam generation with a steam boiler and with further components has been dispensed with.

The generation of fresh steam for the steam turbine 5 is indicated by a heating surface H, by which a flow medium is heated by the action of, for example, hot gas and it can be delivered to the steam turbine 5 as fresh steam.

The steam turbine 5 has two turbine stages with a different operating pressure, to be precise a high-pressure stage HD and a low-pressure stage ND.

Operating steam, in particular fresh steam, is supplied to the steam turbine 5 by a steam valve 10. For the generation of electrical energy, the steam turbine 5 of the steam power plant 1 is coupled to a generator G via a shaft.

Particularly in the event of a load change while the steam power plant is in operation, the steam-carrying component 7 is exposed to a temperature gradient of large amount and is possibly put at risk due to action of the mechanical stresses occurring in this case.

In order, on the one hand, to avoid an overstressing of plant components of the steam power plant, in particular of the steam-carrying component 7, and in order, on the other hand, to ensure that the steam power plant 1 has as high an efficiency as possible, even during a changeover to part-load operation and in part-load operation, a device 2 is provided.

This comprises a pressure sensor SPi arranged in the interior of the steam-carrying component 7, and also a temperature sensor STi likewise arranged in its interior and a temperature sensor STa arranged in the region outside the steam-carrying component 7.

By the sensors, the internal pressure prevailing in the interior of the steam-carrying component, the internal temperature and the temperature in the region outside the steam-carrying component 7 are measured. These measurement values make it possible to draw a conclusion about the mechanical load on the material of the steam-carrying component 7 in a current operating state. The measurement values measured by the sensors are transmitted to a computer C which comprises a computing stage RS1, a comparison stage CS and a regulating stage RS2.

In the computing stage RS1, a calculation program takes place, by which a spatial temperature distribution of the steam-carrying component and a reference stress Vs are calculated from the measurement values, the reference stress being a characteristic variable for the mechanical load on the steam-carrying component 7 in the current operating state. In this respect several calculation methods, in particular what may be referred to as "stress hypotheses", are known from the area of mechanical engineering and/or materials science.

The reference stress Vs determined by the computing stage RS1 and a material limit stress Mgs are transferred to the comparison stage CS.

The material limit stress Mgs is in this case a characteristic variable for a maximum permissible mechanical load on the material of the steam-carrying component 7 due to mechanical stresses. Quantitative values for such material limit stresses of the various materials used for steam-carrying components may be determined, in particular, from the literature relating to materials science and/or mechanical engineering.

If a comparison of the reference stress Vs with the material limit stress Mgs, carried out by the comparison stage CS, yields the result that the reference stress Vs is greater than the material limit stress Mgs in a current operating state, that is to say that, for example, a mechanical overloading and/or premature material fatigues of the steam-carrying component 7 must be expected, then the comparison result triggers a calculation algorithm which is stored in the regulating stage RS2 and by which a limit steam pressure desired value Gd is determined from the currently prevailing operating characteristic variables of the steam-carrying component 7, in particular from its measured internal pressure, its measured internal temperature and its measured external temperature.

The limit steam pressure desired value Gd is a measure of how high the steam pressure acting on the steam-carrying component 7 in a current operating situation should be at a maximum, without an overload of and/or damage to the steam-carrying component 7 having to be feared. The limit steam pressure desired value Gd may be determined, for example, in a simulation calculation. Valve Gd is supplied to a regulating device R.

The limit steam pressure desired value Gd is set in that, by the regulating stage RS2, the steam valve 10 and a stage valve 12, present if appropriate, are set until approximately the calculated limit steam pressure desired value Gd is established.

The current value for the limit steam pressure desired value Gd is dependent on the current operating state of the steam power plant, so that, particularly during the gradual disappearance of the changeover processes in the event of a load change (for example, the gradual disappearance of the temperature difference in the material of the steam-carrying component 7 during/after a load change), the value for the limit steam pressure desired value Gd increases gradually.

This means that the high throttling of the turbine valves 10 and 12 which is first set on account of the high stresses occurring at the commencement of the load change (as a result of the low initial value for the limit steam pressure desired value Gd calculated in this current operating situation) is (gradually) cut back again automatically, since, as already mentioned, during the process of the load change and thereafter, the limit steam pressure desired value Gd increases as a result of the decreasing temperature stresses in the material of the steam-carrying component 7, the pressure load on the steam-carrying component 7 can therefore likewise be increased and consequently the throttling of the turbine valves 10 and 12 is cut back.

The method and the device have, in this only temporary throttling of the turbine valves 10 and 12, particularly during and/or after a load change of the steam power plant 1, an important advantage which, in comparison with the related art, makes it possible to have an increased efficiency during the operation of the steam power plant 1.

A summary follows:

It is proposed that, during the operation of a steam turbine 5 of a steam power plant 1, the internal pressure Pi and also the internal temperature Ti and, in the region outside it, the external temperature Ta are determined in at least one steam-carrying component 7.

As a result of a change in the operating state, particularly in the event of a load change, then, the abovementioned values vary, so that, under some circumstances, the mechanical stresses which in this case act on the steam-carrying component 7 become unacceptably high.

Consequently, a spatial temperature distribution and a reference stress Vs of the steam-carrying component 7 are determined at least from the values Pi, Ti, Ta and are compared with a material limit stress Mgs of the material of the steam-carrying component 7.

If the reference stress Vs is greater than the material limit stress Mgs, a limit steam pressure desired value Gd is determined and at least one steam valve 10 is set in such a way that the steam pressure on the steam-carrying component 7 corresponds approximately to this limit steam pressure desired value Gd.

By the method, an automatic reduction in the throttling is obtained, so that the efficiency of the steam power plant 1, particularly in the part-load range, is increased.

A device 2 serves for carrying out the method.

The invention has been described in detail with particular reference to preferred embodiments thereof and examples, but it will be understood that variations and modifications can be effected within the spirit and scope of the invention.

What is claimed is:

1. A method for operating a steam power plant having a steam turbine, a steam-carrying component and a steam valve to deliver steam to the steam turbine, comprising:

during the operation of the steam power plant, determining an internal pressure, an internal temperature and an external temperature of the steam-carrying component;

determining a spatial distribution of the internal temperature and the external temperature;

from the internal pressure, the internal temperature and the external temperature, determining a reference stress, which describes a current mechanical stress being applied to the steam-carrying component;

comparing the reference stress with a material limit stress which describes an upper limit for the mechanical load-bearing capacity of the steam-carrying component; and if the reference stress is greater than the material limit stress:

determining a limit steam pressure, which describes a maximum permissible steam pressure, by which the steam-carrying component can be acted upon without the risk of damage in the current operating state, and setting the steam valve so that the steam carried by the steam-carrying component is at a pressure which corresponds approximately to the limit steam pressure.

2. The method as claimed in claim 1, wherein the steam-carrying component is a steam separation drum.

3. The method as claimed in claim 1, wherein the steam turbine has at least two turbine stages.

4. The method as claimed in claim 1, wherein the steam turbine has a high pressure stage and a low pressure stage.

5. The method as claimed in claim 4, wherein a stage valve controls delivery of steam to the low-pressure turbine stage, and the stage valve is set in conjunction with the steam valve.

6. The method as claimed in claim 1, wherein the limit steam pressure is determined by a simulation calculation.

7. The method as claimed in claim 2, wherein the steam turbine has a high pressure stage and a low pressure stage.

8. The method as claimed in claim 7, wherein a stage valve controls delivery of steam to the low-pressure turbine stage, and the stage valve is set in conjunction with the steam valve.

9. The method as claimed in claim 8, wherein the limit steam pressure is determined by a simulation calculation.

10. The method as claimed in claim 1, wherein the steam-carrying component carries steam from the turbine.

11. A device for operating a steam power plant having a steam turbine, a steam-carrying component, and a steam valve to deliver steam to the steam turbine, comprising:

an internal-pressure sensor to sense a pressure within the steam-carrying component;

an internal temperature unit to determine an internal temperature of the steam-carrying component;

an external-temperature sensor to sense an outer temperature of the steam-carrying component;

a computing stage to receive the internal pressure, the internal temperature and the external temperature, to determine a spatial distribution of the temperature of the steam-carrying component, and to determine a reference stress describing a current mechanical stress being applied to the steam-carrying component;

a comparison stage to compare the reference stress with a material limit stress which describes an upper limit for the mechanical load-bearing capacity of the steam-carrying component; and a regulating stage, triggered if the reference stress is greater than the material limit stress:

to determine a limit steam pressure, which describes a maximum permissible steam pressure by which the steam-carrying component can be acted upon without the risk of damage in the current operating state, and to regulate the steam valve so that the steam carried by the steam-carrying component is a pressure which corresponds approximately to the limit steam pressure.

12. The device as claimed in claim 11, wherein the steam-carrying component is a steam separation drum.

13. The device as claimed in claim 11, wherein the steam turbine has at least two turbine stages.

14. The device as claimed in claim 11, wherein the steam turbine has a high pressure stage and a low pressure stage.

15. The device as claimed in claim 14, wherein a stage valve controls delivery of steam to the low-pressure turbine stage, and the stage valve is set in conjunction with the steam valve.

16. The device as claimed in claim 11, wherein the limit steam pressure is determined by a simulation calculation.

17. The device as claimed in claim 12, wherein the steam turbine has a high pressure stage and a low pressure stage.

18. The device as claimed in claim 17, wherein a stage valve controls delivery of steam to the low-pressure turbine stage, and the stage valve is set in conjunction with the steam valve.

19. The device as claimed in claim 18, wherein the limit steam pressure is determined by a simulation calculation.

20. The device as claimed in claim 11, wherein the steam-carrying component carries steam from the turbine.

* * * * *